US011248883B2

(12) United States Patent
Burns et al.

(10) Patent No.: US 11,248,883 B2
(45) Date of Patent: Feb. 15, 2022

(54) OPTIMIZED LEVER ACTION FIREARM CARTRIDGE GEOMETRY

(71) Applicant: Vista Outdoor Operations LLC, Anoka, MN (US)

(72) Inventors: Jacob C. Burns, St. Louis Park, MN (US); Jared C. Kutney, Cambridge, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/714,173

(22) Filed: Dec. 13, 2019

(65) Prior Publication Data

US 2021/0180923 A1 Jun. 17, 2021

(51) Int. Cl.
*F42B 5/02* (2006.01)
*F41A 3/66* (2006.01)

(52) U.S. Cl.
CPC ..... *F42B 5/025* (2013.01); *F41A 3/66* (2013.01)

(58) Field of Classification Search
CPC .... F42B 5/00; F42B 5/02; F42B 5/025; F42B 5/26
USPC ..... 102/430, 464, 469
See application file for complete search history.

(56) References Cited

U.S. PATENT DOCUMENTS 110,881 A * 1/1871 White ..... F42B 5/26 102/469
125,830 A * 4/1872 Milbank ..... F42B 5/26 102/469
131,018 A * 9/1872 Milbank ..... F42B 5/26 102/469
259,237 A * 6/1882 Stocking ..... F42B 5/26 102/469
1,060,818 A * 5/1913 Clyne ..... F42B 5/26 102/469
1,065,811 A * 6/1913 Johnson ..... F42B 5/26 102/465
1,795,191 A * 3/1931 Woodford ..... F42B 5/26 138/145
2,877,590 A * 3/1959 Morse ..... F41A 9/72 42/6
4,063,486 A * 12/1977 Ashley ..... F42B 5/16 89/7
4,454,817 A * 6/1984 Bockstruck ..... F42B 5/26 102/448
4,686,905 A * 8/1987 Szabo ..... F42B 5/02 102/444
5,710,391 A * 1/1998 Chetcuti ..... F42B 5/05 102/430
5,768,815 A * 6/1998 Casull ..... F41A 15/12 42/16
2007/0234923 A1* 10/2007 Reynolds ..... F42B 5/28 102/469

(Continued)

*Primary Examiner* — Bret Hayes
(74) *Attorney, Agent, or Firm* — Reed Smith LLP; Matthew P. Frederick; John M. Cogill

(57) ABSTRACT

A cartridge casing of a cartridge for a lever action firearm, the cartridge casing comprising a rim comprising a flat front face configured to provide a gripping surface for an extractor of the lever action firearm to remove the cartridge casing of the cartridge after firing of the lever action firearm, the rim having a radial gradient that decreases from a maximum radius at a first location on the rim that is prior to the flat front face to a minimum radius value at a second location on the rim corresponding to the flat front face.

13 Claims, 11 Drawing Sheets

(56) References Cited

U.S. PATENT DOCUMENTS

| | | | | |
|---|---|---|---|---|
| 2011/0048269 | A1* | 3/2011 | Schuster | F42B 5/025<br>102/470 |
| 2014/0311332 | A1* | 10/2014 | Carlson | F41A 5/18<br>89/191.01 |

* cited by examiner

OPTIMIZED LEVER ACTION FIREARM CARTRIDGE GEOMETRY

BACKGROUND

Lever action firearms have existed since the mid-nineteenth century. Lever action is a method of loading cartridges into a chamber of a firearm barrel that uses a lever located near the trigger guard of the firearm. This is in contrast to other loading mechanisms, such as bolt-action, pump-action, or semi-automatic loading mechanisms.

One problem with lever action firearms is that the design of many rimmed cartridges causes them to get hung up in the tubular magazine of the firearm. This makes loading cartridges into the magazine difficult and very frequently results in firearm malfunctions such as being unable to operate the lever due to a jam within the magazine.

Although lever action firearms have existed since the mid-nineteenth century, no solution to this problem has been derived. Part of the reason for this is that any modification of the cartridge could result in compatibility issues between the redesigned cartridge and the lever action firearms on which it was intended to be utilized. Another reason is that any modification of the cartridge could interfere with proper operation of the weapon. For example, if the diameter of the cartridge were reduced, this could result in an inability of an extractor mechanism of the firearm to extract the cartridge casing after discharge of the firearm.

Consequently, there is a need for improvements in lever action firearm cartridges and cartridge cases that alleviate this problem and that maintain compatibility with existing lever action firearms.

DETAILED DESCRIPTION

While cartridges and cartridge cases are described herein by way of examples and embodiments, those skilled in the art recognize that the disclosed cartridge and cartridge casing are not limited to the embodiments or drawings described. It should be understood that the drawings and description are not intended to be limited to the particular form disclosed. Rather, the intention is to cover all modifications, equivalents and alternatives falling within the spirit and scope of the present disclosure. Any headings used herein are for organizational purposes only and are not meant to limit the scope of the description. As used herein, the word "can" is used in a permissive sense (i.e., meaning having the potential to) rather than the mandatory sense (i.e., meaning must). Similarly, the words "include," "including," and "includes" mean including, but not limited to.

As discussed above, improvements are needed in the area of lever action firearm cartridges and cartridge casings. Applicant has discovered a novel lever action cartridge casing geometry that reduces the coefficient of friction between the rim of the cartridge and the tubular magazine of the lever action firearm and that therefore enables the cartridge to be loaded into the tubular magazine of lever action firearm without causing jams or other undesirable effects.

Moreover, the novel lever action cartridge casing geometry disclosed herein accomplishes this improvement without compromising compatibility between the cartridge and the intended firearm and without compromising the operation of the firearm. The cartridge casing geometry disclosed herein meets relevant ammunition standards (such as the Sporting Arms and Ammunition Manufacturers' Institute ("SAAMI") standards) and is configured to allow the firearm to properly discharge the cartridge and extract the spent cartridge casing.

Figure 1:
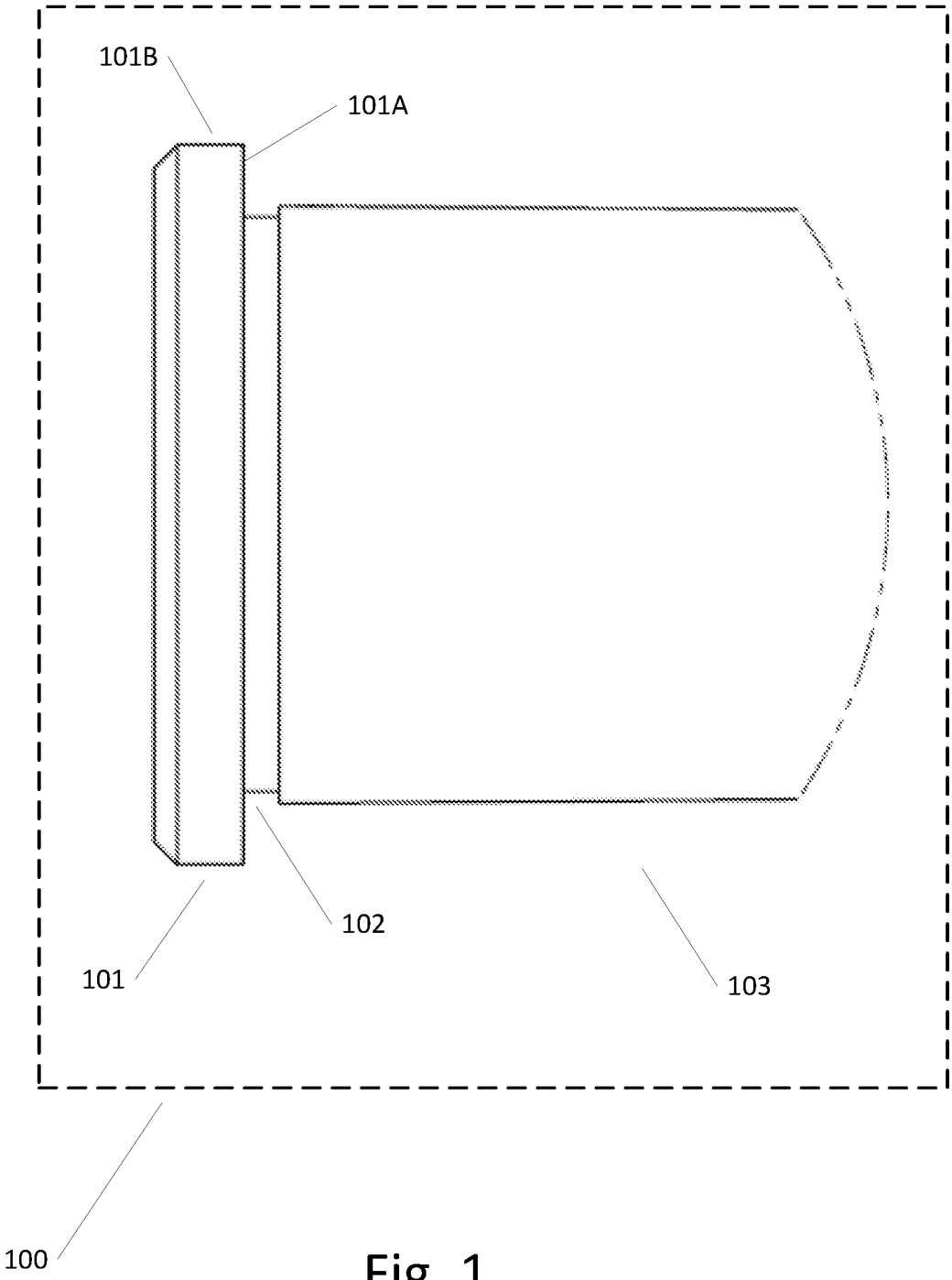
Fig. 1 Prior Art
FIG. 1 illustrates a side view of an existing geometry for a cartridge casing for a lever action firearm.

FIG. 1 illustrates a side view of an existing geometry for a cartridge casing 100 for a lever action firearm. The cartridge casing shown in FIG. 1 includes only the rear portion of the cartridge casing for clarity.

As shown in FIG. 1, the cartridge casing includes a rim 101 having a front wall 101A that is gripped by an extractor mechanism after the cartridge is discharged by the firearm. The front wall 101A is required to have certain characteristics (such as radius, orientation, etc.) that will allow the extractor mechanism to hook the spent cartridge casing and remove it from the firearm. While the particular characteristics of this front wall will vary between firearms, it is essential that any modification of the lever action firearm cartridge casing preserve these characteristics in order to guarantee functionality of the extractor mechanism.

The rim 101 also includes a cylindrical outer wall 101B that is the widest point of the cartridge casing and which typically causes many of the loading problems discussed previously. Additionally, the cartridge casing can optionally include a groove 102 adjacent to the rim and a frontal section, a portion of which is indicated by numeral 103. The frontal section will typically contain the gunpowder and projectile (bullet), while the primer will be located closer to the rim 101 of the casing 100.

Figure 2:
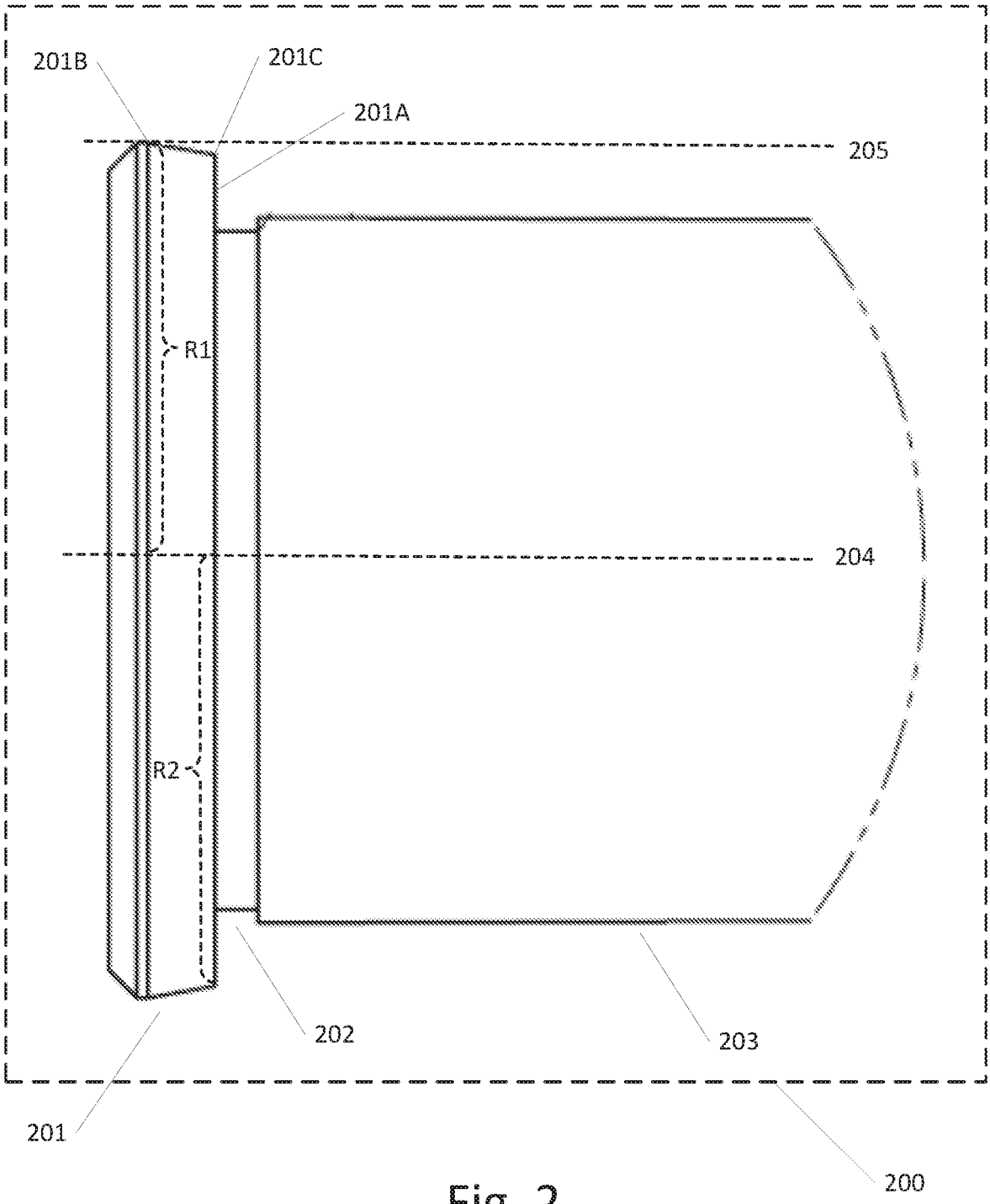
FIG. 2 illustrates a side view of a cartridge casing for a lever action firearm according to an exemplary embodiment.

FIG. 2 illustrates a side view of a cartridge casing 200 for a lever action firearm according to an exemplary embodiment. The cartridge casing shown in FIG. 2 includes only the rear portion of the cartridge casing 200 for clarity. The cartridge casing can be a casing for any type of lever action firearm cartridge, such as a 3030 cartridge, a 357 cartridge, a 327 cartridge, a 44 cartridge, a 45 cartridge, and/or a 45-70 cartridge.

As shown in FIG. 2, the cartridge casing 200 includes a rim 201 having a flat front face 202. The flat front face 202 conforms to the requirements of the extractor mechanism of the firearm and is configured to provide a gripping surface for an extractor of the lever action firearm to remove the cartridge casing of a cartridge after firing of the lever action firearm.

Unlike a standard lever action firearm cartridge casing, the rim 201 of the cartridge casing 200 has a radial gradient that decreases from a maximum radius at a first location 201B on the rim 201 that is prior to the flat front face 201A to a minimum radius value at a second location 201C on the rim 201 corresponding to the flat front face 201A. It is understood that radius in this context refers to the radius for a cross section of the rim at a particular location, from the center of cartridge casing, denoted by dashed line 204, to the location on the outer wall of the rim 201, on a plane perpendicular to the dashed line 204. For example, the radius at first location 201B on the rim 201 is given by distance R1 and the radius at the second location 201C on the rim 201 is given by the distance R2. Additionally, it is understood that the term location, as used herein, refers to a longitudinal position on the rim 201 of the cartridge casing 200.

The radial gradient does not need to decrease continuously. For example, the radius may decrease from the maximum radius portion of the rim (the cross section of which defines a circle having a radius $R_{max}$) increase at some intermediate point, and then further decrease to reach a minimum radius at the front face (the cross section of which defines a second circle having a radius $R_{min}$).

The radius of the cross-sectional slice of the front face 201A is configured to be large enough to enable the extraction mechanism of the firearm to extract the cartridge case after discharge of the firearm. Although groove 202 is optional and not required, it can optionally be utilized to provide space for the extraction mechanism of the firearm to grip the front face 201A of the rim.

The rimmed cartridge casing 200 shown in FIG. 2 has the advantage of having a reduced coefficient of friction between the cartridge casing at the tubular magazine of the firearm. In particular, the radial gradient of the rim ensures that there is minimum contact between the cartridge casing and the tubular magazine, while maintaining the required rim radius to ensure that the firearm is able to properly utilize cartridges made with the cartridge casing.

The radial gradient between the maximum radius and minimum radius can different values depending upon the particular tolerances of the firearm. In an exemplary embodiment, the radial gradient comprises a value in a range from 0.005 inches to 0.009 inches, inclusive. As discussed further in this application, the inventors have found that a radial gradient within this range, and at 0.007 in particular, results in an improved cartridge casing which greatly reduces loading problems while maintaining compatibility with the requirements of the firearm and relevant standards.

The radial gradient can be implemented in variety of ways. As shown in FIG. 2, the radial gradient is implement with a chamfer (sometimes referred to as a bevel) that extends from the first location 201B on the rim to the second location 201C on the rim 201. When seen from a side view, as shown in FIG. 2, the chamfer results in a downward sloping rim from the maximum radius location to the front face. However, when viewed in three dimensions, the radial gradient implemented by the chamfer would result in a the corresponding portion of the rim having a conical shape in which the circumference of the outer wall decreases from the first location 201B to the second location 201C.

The chamfer can be sloped at a number of angles depending upon the particular tolerances of the firearm. In an exemplary embodiment, the chamfer is sloped at a 10 degree angle relative to a line 205 running through the first location 201B on the rim 201 and parallel to a longitudinal axis 204 of the cartridge casing 200.

As shown in FIG. 2, the cartridge casing 200 can optionally include a groove 102 adjacent to the rim 201 and a frontal section, a portion of which is indicated by numeral 203. The frontal section will typically contain the gunpowder and projectile (bullet), while the primer will be located closer to the rim 201 of the casing 200.

Figure 3:
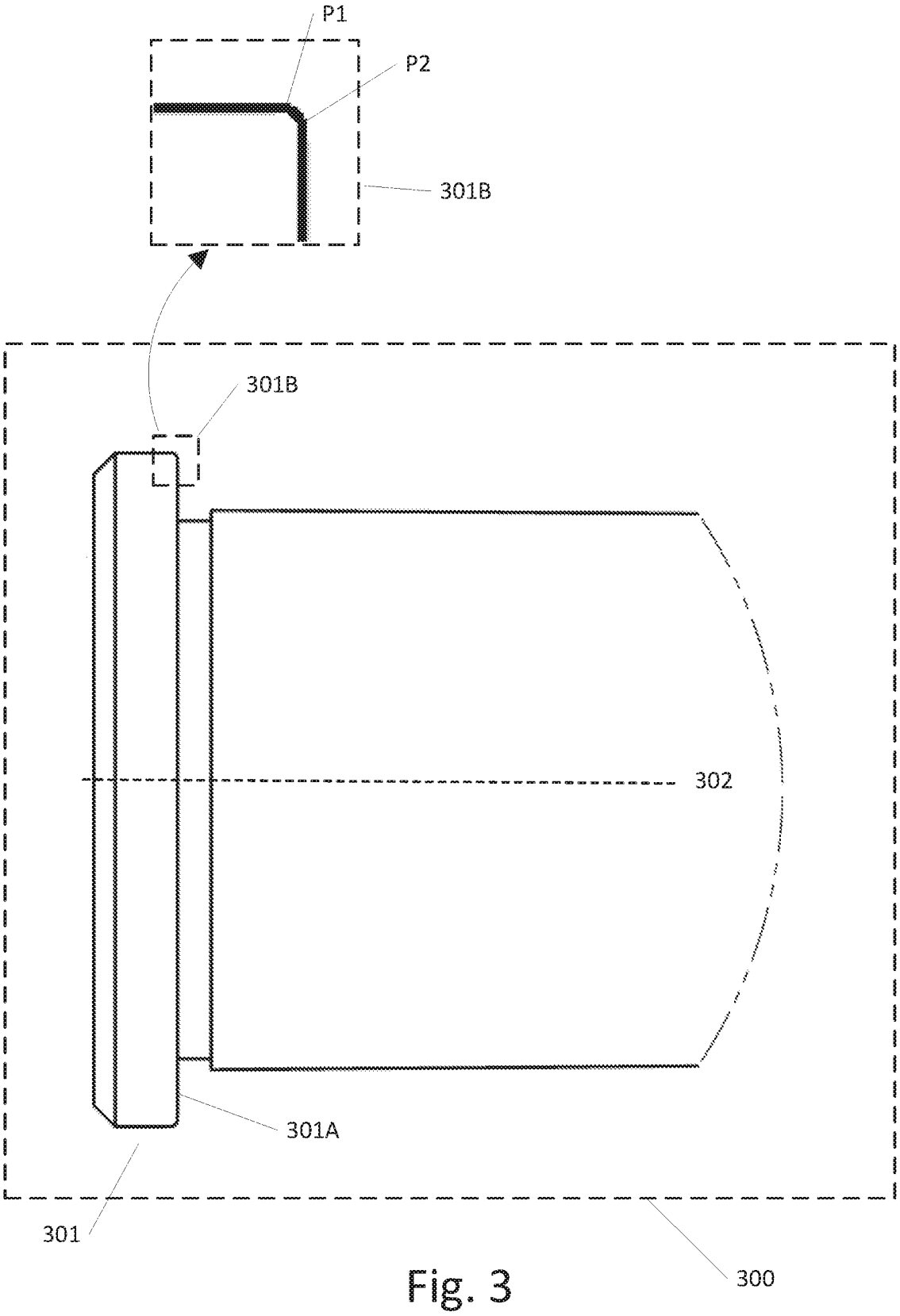
FIG. 3 illustrates another cartridge casing according to an exemplary embodiment.

FIG. 3 illustrates another cartridge casing 300 according to an exemplary embodiment. Cartridge casing 300 is similar to casing 200, and also includes a rim 301 having flat front face 301A and a radial gradient. However, the radial gradient of the rim 301 of cartridge casing 300 is implemented using a radiused edge rather than a chamfer.

The radiused edge is shown in window 301B, enlarged for clarity. As shown in 301B, the radiused edge extends from location P1 on the rim 301 to location P2 on the rim 301. This results in a radial gradient on the rim 301 that decreases from a maximum radius at a first location P1 (and at multiple locations prior to P1) on the rim 301 that is prior to the flat front face 301A to a minimum radius value at a second location P2 on the rim 301 corresponding to the flat front face 301A. As is apparent from the figure, the radial distance from location P1 to the center of the rim 301 (denoted by line 302) is clearly greater than the radial distance from location P2 to the center of the rim 301.

As shown in FIG. 3, the radiused edge is a convex edge. However, a concave edge can be used to implement the radial gradient as well. Additionally, radius of the radiused edge itself can take a number of values depending upon the particular tolerances of the firearm. In an exemplary embodiment, the radiused edge has a radius of 0.025 inches.

Figure 4:
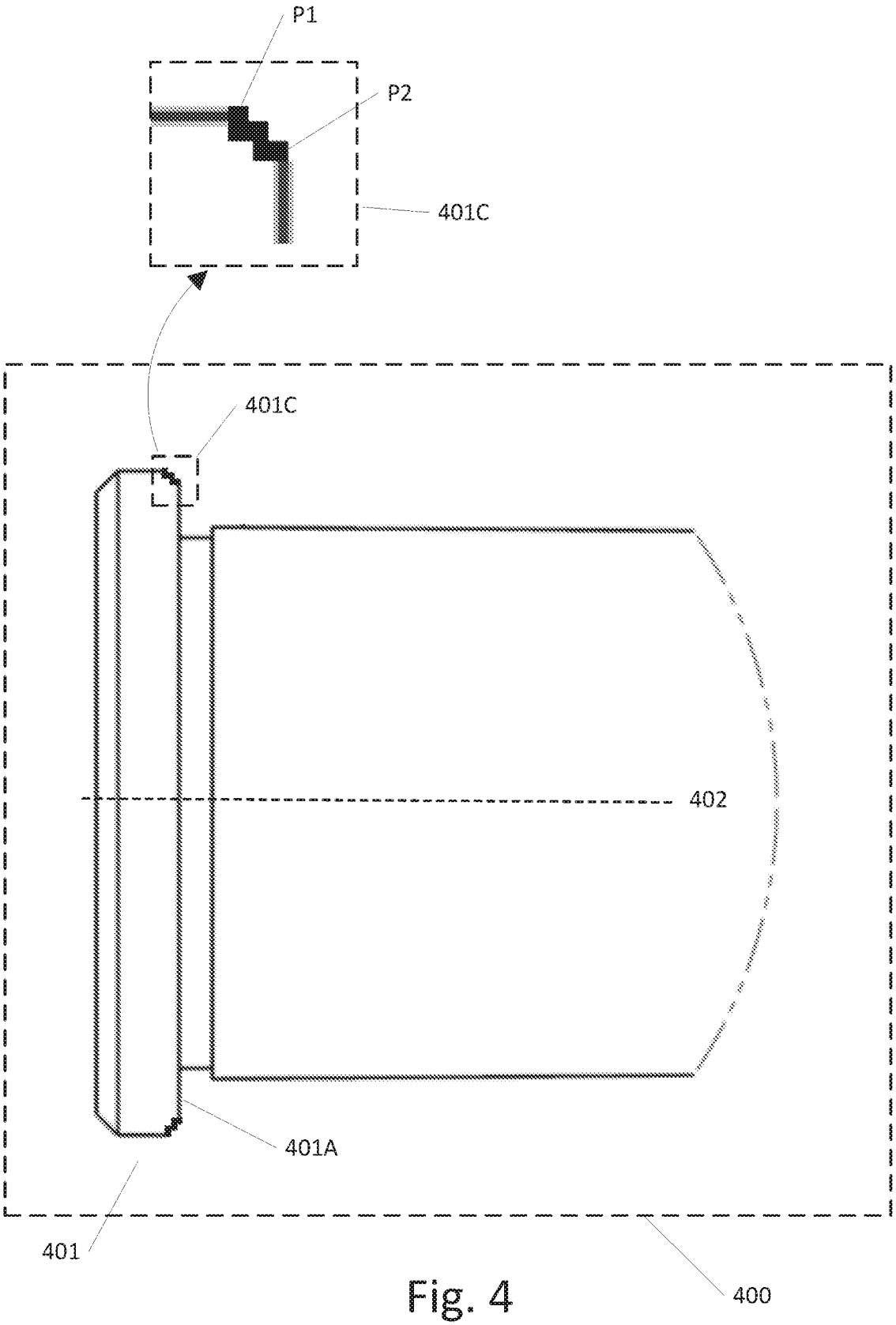
FIG. 4 illustrates another cartridge casing according to an exemplary embodiment.

FIG. 4 illustrates another cartridge casing 400 according to an exemplary embodiment. Cartridge casing 400 is similar to casing 300 and casing 200, and also includes a rim 401 having flat front face 401A and a radial gradient. However, the radial gradient of the rim 401 of cartridge casing 400 is implemented using a stair-step edge rather than a radiused edge or a chamfer.

The stair-step edge is shown in window 401B, enlarged for clarity. As shown in 401B, the stair-step edge extends from location P1 on the rim 401 to location P2 on the rim 401 that corresponds to the front face 401A. This results in a radial gradient on the rim 401 that decreases from a maximum radius at a first location P1 (and at multiple locations prior to P1) on the rim 401 that is prior to the flat front face 401A to a minimum radius value at a second location P2 on the rim 401 corresponding to the flat front face 401A. As is apparent from the figure, the radial distance from location P1 to the center of the rim 401 (denoted by line 402) is clearly greater than the radial distance from location P2 to the center of the rim 401. While two steps are shown in the stair-step edge of this example, any number of steps can be used.

Figure 5:
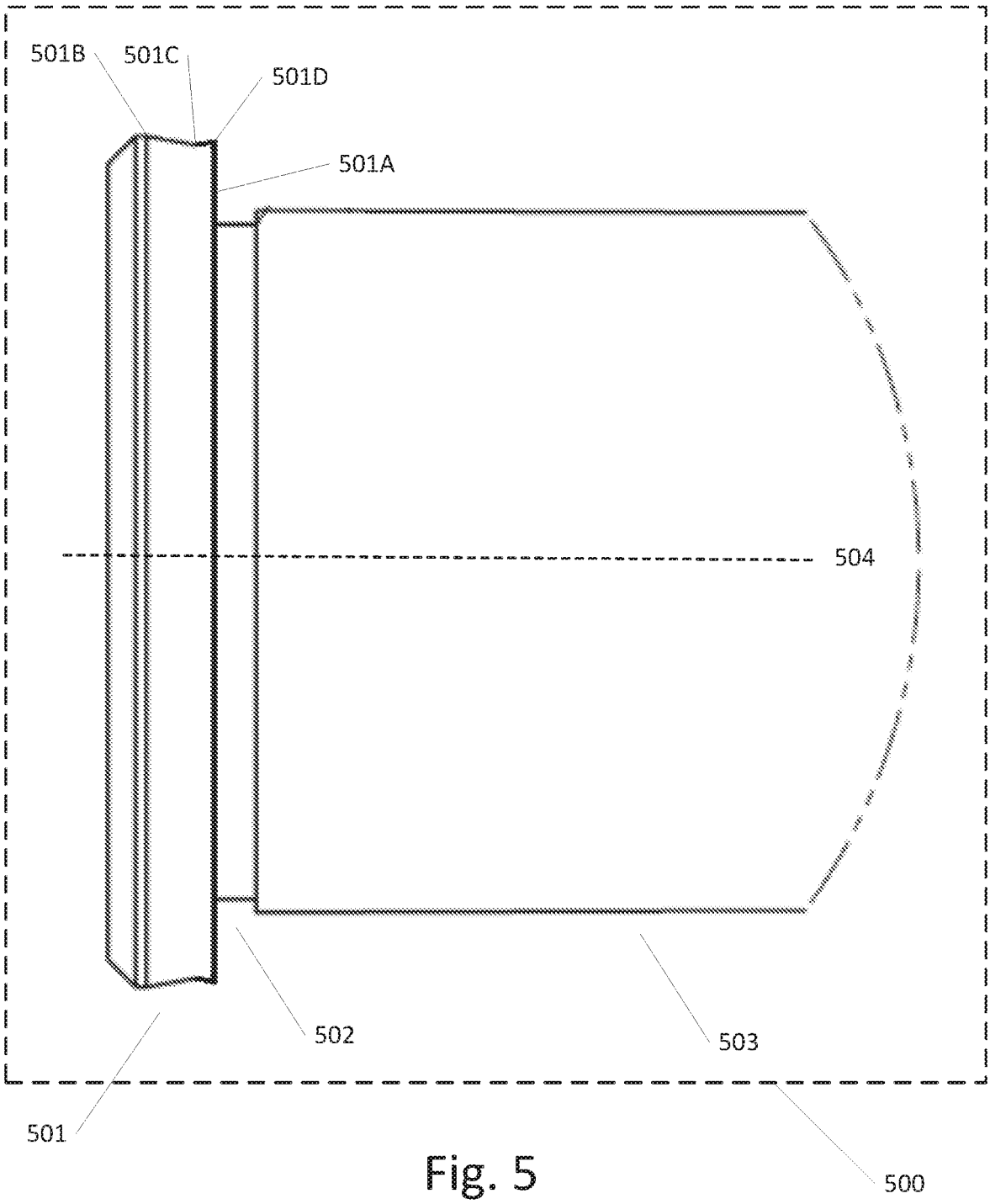
FIG. 5 illustrates another cartridge casing according to an exemplary embodiment.

FIG. 5 illustrates another cartridge casing 500 according to an exemplary embodiment. Cartridge casing 500 is similar to casings 400, 300 and casing 200, and also includes a rim 501 and a radial gradient. The rim 501 of casing 500 also includes a flat front face configured to provide a gripping surface for an extractor of the lever action firearm to remove a casing of the rimmed cartridge after firing of the lever action firearm. Front section 503 of the cartridge casing 500 is similar to the front section 200 shown in FIG. 2 (and in FIGS. 3-4).

However, the cartridge casing 500 differs from the previous shown casings (200, 300, 400) in that the rim has a radial gradient that decreases from a maximum radius at a first location 501B on the rim 501 that is prior to the flat front face 501A to a minimum radius value at a second location 501C on the rim 501 that is closer to the flat front face 501A than the first location, but which does not necessarily correspond to the front face 501A. For reference, the location on the rim 501 corresponding to the front face 501A is given by numeral 501D.

As shown in FIG. 5, the radial gradient of rim decreases from location 501B to 501C, but then increases again at location 501D, corresponding to the front face 501A. The radius of the rim at location 501D (corresponding to the front face 501A) is still less than the radius of the rim at location 501B, which has the maximum rim radius. Consequently, the cartridge casing 500 shown in FIG. 5 also lowers the number of contact points between the cartridge casing and the tubular magazine of the firearm, thereby lowering the coefficient of friction.

The radial gradient of the casing shown in FIG. 5 can be implemented using any of the techniques described with respect to FIG. 2-4, e.g., using a chamfer (bevel), a radiused edge that curves back up at the front face, or a decreasing stair-step that then increases at the front face.

As discussed previously, the cartridge casing can be the casing of any type of lever action cartridge, such as a 3030 cartridge, a 357 cartridge, a 327 cartridge, a 44 cartridge, a 45 cartridge, and/or a 45-70 cartridge. FIGS. 6-9 illustrate technical specifications of the disclosed cartridge casing for these cartridges according to an exemplary embodiment.

Figure 6:
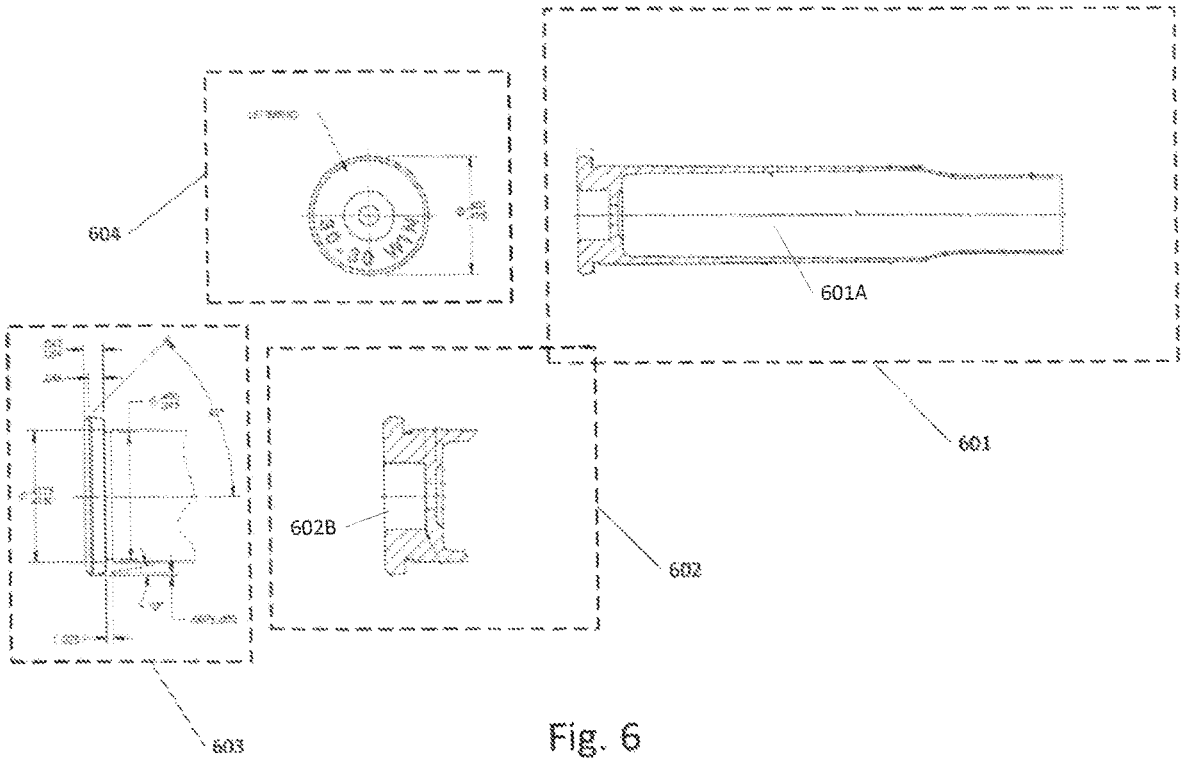
FIG. 6 illustrates views of a 30-30 cartridge case according to an exemplary embodiment.

FIG. 6 illustrates a cross-sectional view 601, a cross-sectional back end cutout 602, side plan view back-end cutout 603, and back view 604 of a 30-30 cartridge case according to an exemplary embodiment. Hollow portion 601A in the cross-sectional view 601 of the 30-30 cartridge case is configured to hold gunpowder and the payload (bullet) of the 30-30 cartridge and hallow portion 602B in the cross-sectional back end cutout view 602 is configured to hold the primer.

Figure 7:
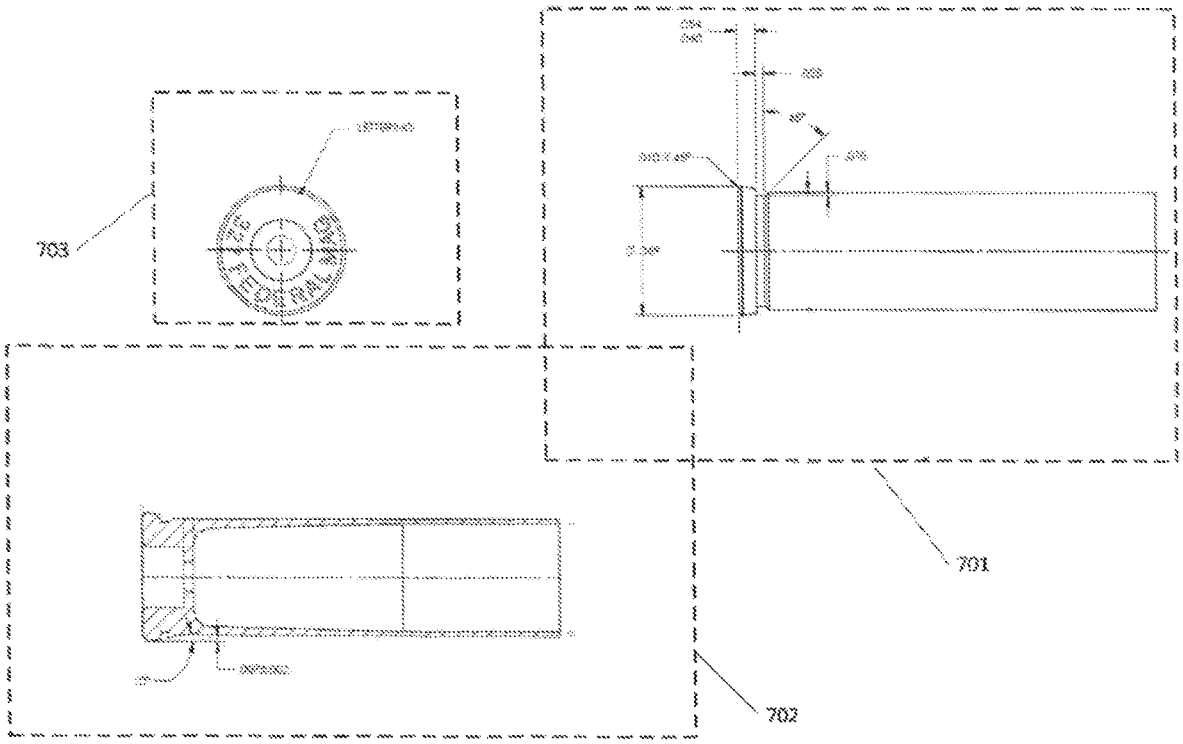
FIG. 7 illustrates views of a 327 cartridge case according to an exemplary embodiment.

FIG. 7 illustrates a side plan view 701, a cross-sectional view 702, and a back view 703 of a 327 cartridge case according to an exemplary embodiment.

Figure 8:
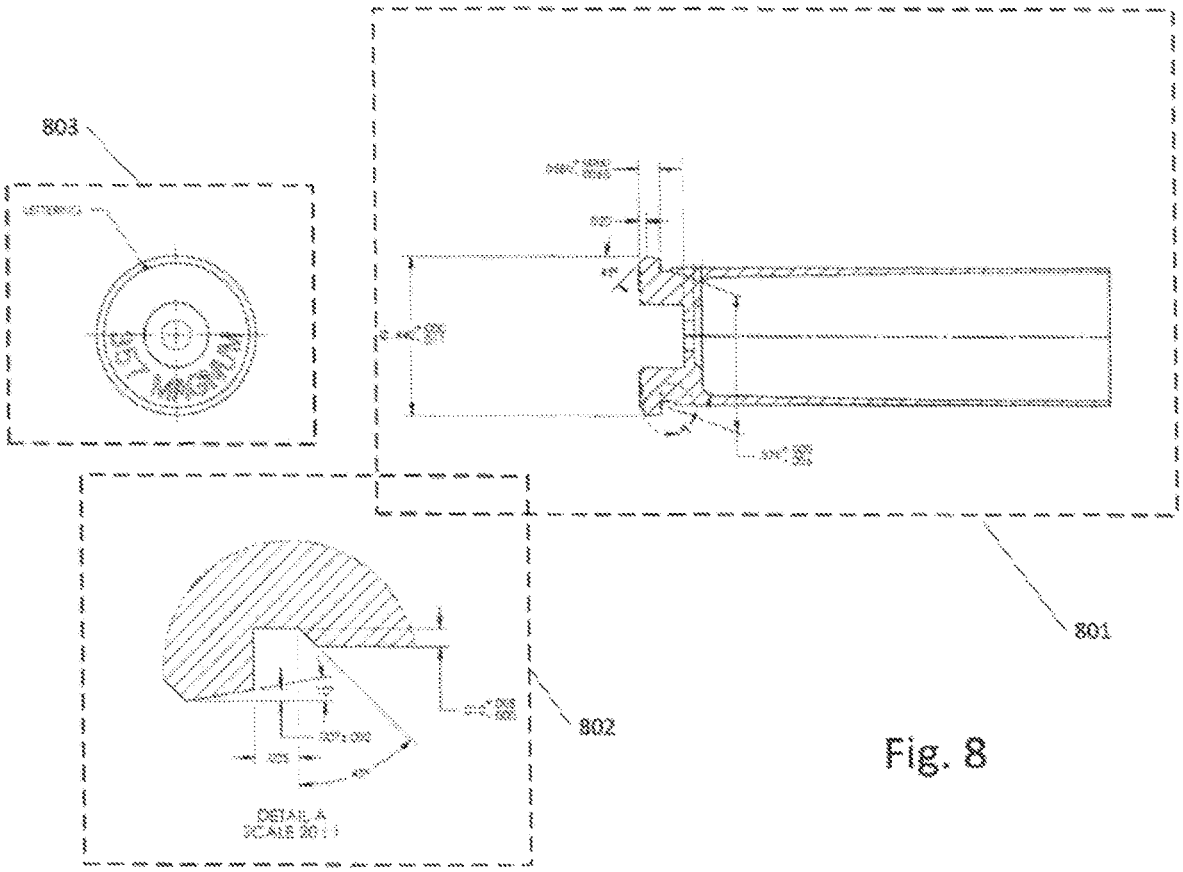
FIG. 8 illustrates views of a 357 cartridge case according to an exemplary embodiment.

FIG. 8 illustrates a cross-sectional view 801, a side plan view of the rim geometry 802, and a back view 803 of a 357 cartridge case according to an exemplary embodiment.

As shown in the cartridge cases of FIGS. 6-8, the radial gradient of the rim for these cartridge cases can be implemented using a chamfered edge that is sloped at a 10 degree angle to a line running parallel to a longitudinal axis of each casing, resulting in a radial gradient of 0.007 inches. As shown in the cartridge cases of FIGS. 6-9, in embodiments of the present disclosure, the rim for these cartridge cases are one-piece with the casing.

Figure 9:
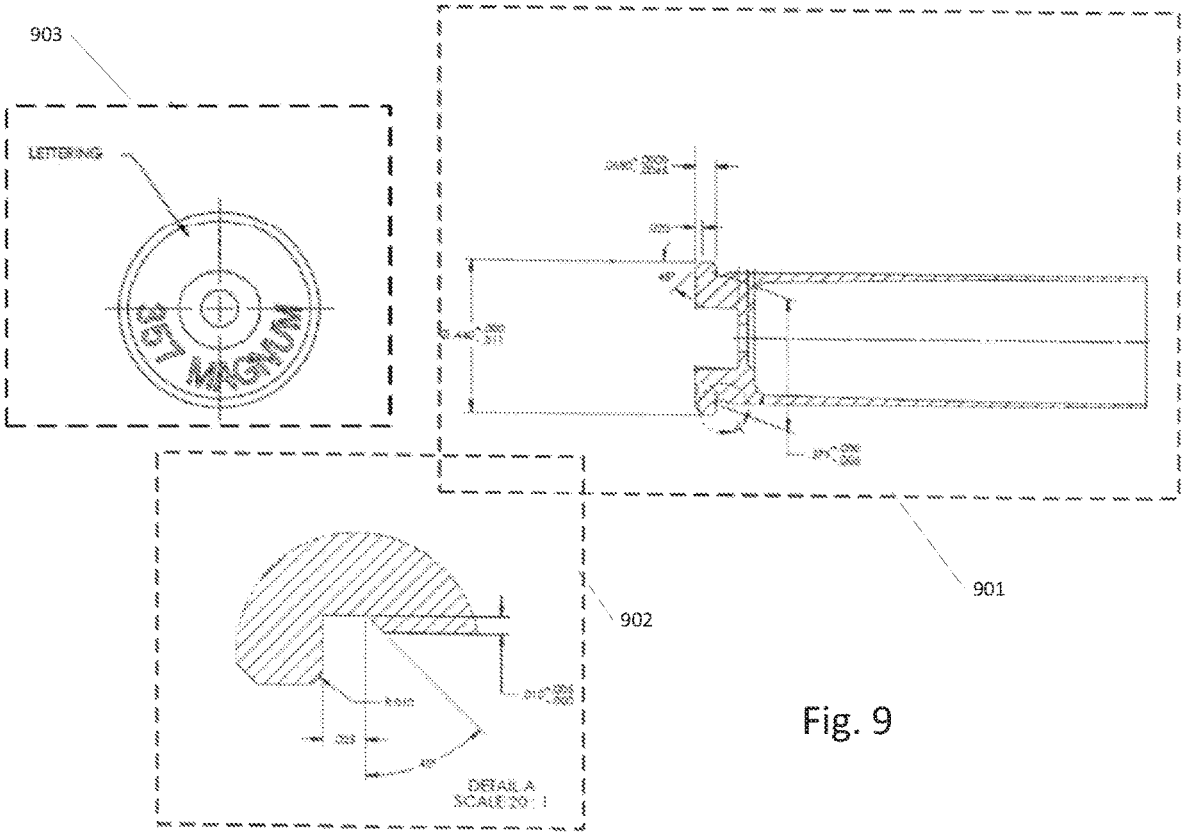
FIG. 9 illustrates views of a 357 cartridge case that utilizes a radiused edge to implement the radial gradient of the rim according to an exemplary embodiment.

However, as discussed earlier, the radial gradient can be implemented in other ways. For example, FIG. 9 illustrates a cross-sectional view 901, a side plan view of the rim geometry 902, and a back view 903 of a 357 cartridge case that utilizes a radiused edge to implement the radial gradient of the rim according to an exemplary embodiment. As shown in FIG. 9, the radiused edge has a radius of 0.010 inches.

Figure 10A:
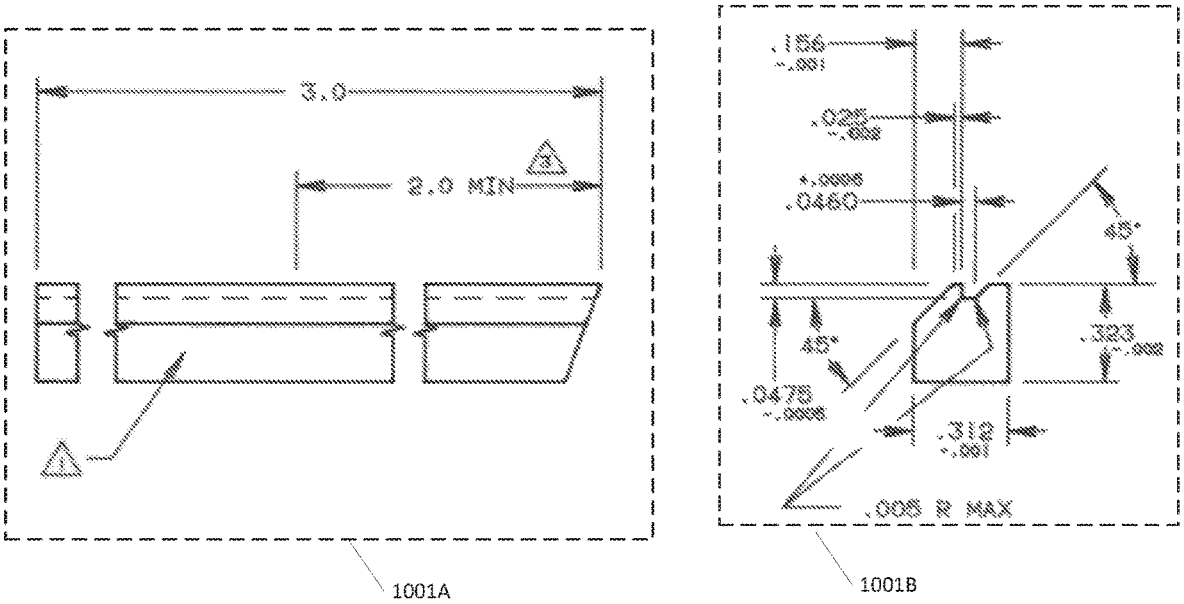
FIG. 10A illustrates views of a current form tool used to form existing 30-30 cartridge cases.
Figure 10B:
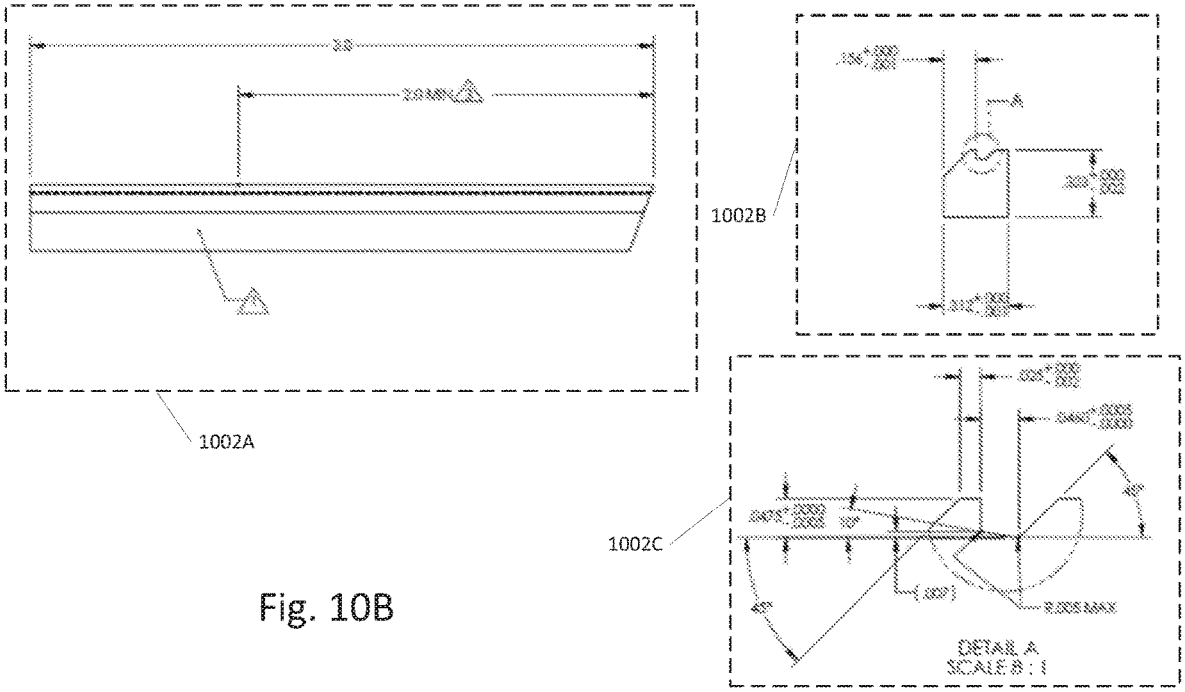
FIG. 10B illustrates views of a specialized form tool according to an exemplary embodiment used to form the specialized cartridge casings disclosed herein.

The machining and shaping of the cartridge case disclosed herein requires specialized form tools/machining knives. FIG. 10A illustrates a side view 1001A and a front view 1001B of a current form tool used to form existing 30-30 cartridge cases. By contrast, FIG. 10B illustrates a side view 1002A, a front view 1002B, and a detailed groove view 1002C of a specialized form tool according to an exemplary embodiment used to form the specialized cartridge casings disclosed herein. As shown in detailed view 1002C, a bottom face of a groove within the specialized form tool is sloped to impart a radial gradient to the cartridge casing. This differs from the form tool shown in FIG. 10A, in which the bottom face of a groove within the form tool is not sloped but is flat. A similar specialized form tool can be created for any lever action firearm cartridge by making the same change to an existing form tool for a particular type of cartridge.

Having described and illustrated the principles of our invention with reference to the described embodiment, it will be recognized that the described embodiment can be modified in arrangement and detail without departing from such principles.

In view of the many possible embodiments to which the principles of our invention can be applied, we claim as our invention all such embodiments as can come within the scope and spirit of the following claims and equivalents thereto.

We claim:

1. A cartridge casing of a cartridge for a lever action firearm, the cartridge casing comprising:

a rim extending outwardly from the cartridge casing and comprising a flat front face, the flat front face configured to provide a gripping surface for an extractor of a lever action firearm to remove the cartridge casing of the cartridge after firing;

the rim having a radial gradient that decreases from a maximum radius at a first location on the rim that is prior to the flat front face to a minimum radius value at a second location on the rim corresponding to the flat front face, the radial gradient further comprising a chamfer extending from the first location on the rim to the second location on the rim.

2. The cartridge casing of claim 1, wherein the chamfer is sloped at a 10 degree angle relative to a line running through the first location on the rim and parallel to a longitudinal axis of the cartridge casing.

3. The cartridge casing of claim 1, wherein the radial gradient comprises a value in a range from 0.005 inches to 0.009 inches, inclusive.

4. The cartridge casing of claim 3, wherein the radial gradient comprises 0.007 inches.

5. The cartridge casing of claim 1, wherein the cartridge comprises one of: a 3030 cartridge, a 357 cartridge, a 327 cartridge, a 44 cartridge, a 45 cartridge, or a 45-70 cartridge.

6. The cartridge casing of claim 1, the flat front face being substantially perpendicular to a frontal portion of the cartridge casing.

7. The cartridge casing of claim 1, further comprising a groove in a frontal portion of the cartridge casing, the groove for increasing the size of the front face.

8. A rimmed cartridge for a lever action firearm, the rimmed cartridge comprising:

a casing;

a rim being one-piece with the casing, the rim extending radially outwardly from a casing of the rimmed cartridge and comprising a flat front face for gripping by an extractor of a lever action firearm to remove the casing;

the rim having a radial gradient that decreases from a maximum radius at a first location on the rim that is prior to the flat front face to a minimum radius value at a second location on the rim that is closer to the flat front face than the first location.

9. The rimmed cartridge of claim 8, the radial gradient further comprising a chamfer extending from the first location on the rim to the second location on the rim.

10. The rimmed cartridge of claim 9, wherein the chamfer is sloped at a 10 degree angle relative to a line running through the first location on the rim and parallel to a longitudinal axis of the cartridge casing.

11. The rimmed cartridge of claim 8, wherein the radial gradient comprises a value in a range from 0.005 inches to 0.009 inches, inclusive.

12. The rimmed cartridge of claim 11, wherein the radial gradient comprises 0.007 inches.

13. The rimmed cartridge of claim 8, wherein the cartridge comprises one of: a 3030 cartridge, a 357 cartridge, a 327 cartridge, a 44 cartridge, a 45 cartridge, or a 45-70 cartridge.

* * * * *